US005297011A

United States Patent [19]

Triunfol

[11] Patent Number: 5,297,011

[45] Date of Patent: Mar. 22, 1994

[54] LIGHTED CORNER GUARD

[76] Inventor: George Triunfol, 935 Seton Ct., Wheeling, Ill. 60090

[21] Appl. No.: 928,993

[22] Filed: Aug. 12, 1992

[51] Int. Cl.[5] ..... F21S 1/02

[52] U.S. Cl. ..... 362/147; 362/31

[58] Field of Search ..... 362/147, 151, 31, 217, 362/223, 146, 32

[56] References Cited

U.S. PATENT DOCUMENTS

| | | | |
|---|---|---|---|
| 4,434,453 | 2/1984 | Campbell | 362/217 |
| 4,625,266 | 11/1986 | Winter | 362/145 |
| 4,748,547 | 5/1988 | Baker | 362/217 |

*Primary Examiner*—Ira S. Lazarus

*Assistant Examiner*—L. Heyman

*Attorney, Agent, or Firm*—McHale & Slavin

[57] ABSTRACT

A lightable corner guard available for attachment to the protruding corner edge of two adjoining walls. The corner guard utilizes a flexible cover to protect occupants and objects that impact the corner edge. In a preferred embodiment, the corner guard utilizes a microphone amplifying control circuit that is activated upon the receipt of sound from a conventional smoke alarm. The control circuit directing battery voltage to a step-up transformer which in turn energizing flash tubes for illuminating the corner guard and surrounding area. The control circuit includes an oscillator for strobing the flash tubes and a sleep cycle to conserve battery power.

15 Claims, 3 Drawing Sheets

LIGHTED CORNER GUARD

FIELD OF THE INVENTION

This invention relates generally to emergency lighting devices, and, more particularly, to a lightable corner guard which mounts to the protruding corner edge of two adjoining walls having a means for illumination of the corner guard and immediate surrounding area in the event of predetermined emergencies.

BACKGROUND OF THE INVENTION

Corner guards are well known for their ability to protect the protruding edge of two adjoining walls. The protruding edge is a 90 degree right angle extending from the floor to the ceiling at the juncture of two adjoining walls, the protruding edge also referred to as the corner, the corner edge, or simply the edge. The primary purpose of the conventional corner guard is to protect the edge from damage. For example, if the corner edge is painted and a chair is pushed into the edge, the corner may chip unless protected by a corner guard. If the wall is covered with decorative wall covering such as wallpaper and a person brushes against the edge, the paper will peel unless protected by a corner guard. The use of inflexible materials such as tile or brick for construction assures protection of the corner edge despite the regularity in which the corner edge impacted, however, injury is expected to befall a person who accidentally collides with a corner edge made from inflexible materials.

During an emergency many people, especially the very young and very old, can become confused, disoriented, and lost, increasing the likelihood of injury if the person collides with an inflexible corner edge. If an emergency is accompanied by a loss of hallway illumination the inflexible corner edge becomes a dangerous obstacle. Those familiar with commercial buildings, especially retirement homes and hospitals are cognizant of the safety problems that accompany an emergency situation where no natural lighting is available. Due to these safety problems most jurisdictions require, by law, that commercial buildings whether public or private have emergency lighting to assist persons in avoiding corner edges or other obstacles that become dangerous obstacles in an unlit area.

The most familiar type of emergency lighting is an "EXIT" sign illuminated over designated escape routes. The exit sign is regulated by building codes and strategically placed over doorways or along the ceiling of corridors pointing toward a continuous and unobstructed means of egress to a pubic way. Exit signs are designed to be illuminated at all times whether or not a situation is termed emergency by a light source capable of sign illumination. However, illumination of an exit sign does not provide sufficient illumination for an occupant to safely avoid obstacles that are not illuminated, such as protruding corner edges. Code requires illumination of the exit sign, not the corridor leading up to the exit sign. For example, if smoke fills a corridor, occupants are expected to move through the corridor quickly while remaining as close to the floor surface as possible to prevent smoke inhalation, smoke filling the ceiling area first. The danger then arises that the occupants near the floor may strike a corner edge in their haste to escape. In addition, illumination of an exit sign mounted high overhead will not, in most situations, provide illumination if smoke covers the sign. Thus, without proper illumination the occupants may further succumb to panic leaving them confused, disoriented, or lost increasing the probability of injury to themselves and others.

One device used to overcome insufficient illumination during an emergency is spot lighting. Spot lights employ high intensity tungsten-halogen lamps using 1000 or higher wattage and are well suited for large unobstructed areas like factory warehouses, the singular source of light refracted and distributed over the area. Typically the electrical source is provided by a battery power supply with an AC charger during wait-state conditions. In the event of an emergency, the spot light has a means for automatically switching to the battery supply of electricity necessary to illuminate the spot lights during the emergency to provide the continuous supply. While the size of the battery depends upon the brilliance of light, the combination of battery, battery charger, and switch over device coupled with the spot lights is bulky. Placement of a conventional spot light near the base of a wall creates an unacceptable obstruction that may cause injury in and of itself.

When spot lighting is placed overhead in a confined area such as a corridor, the non-diffused light can add to disorientation or cause temporary blinding if an occupant looks at the light even momentarily. Since smoke is an excellent diffuser of light, spot lighting that illuminates a smoke filled corridor may cause a white-out effect creating a visual situation similar to that of having no light present.

Thus, the need for protecting a person from impacting a corner edge during an emergency is not being met, while efforts have been made toward effectively and simply resolving these problems, no satisfactory solution has heretofore been provided. My invention is specifically designed to compliment and in many situations overcome the aforementioned problems by providing a low cost, energy efficient illuminated corner guard. It is, therefore, to the effective resolution of these problems that the present invention is directed.

SUMMARY OF THE INVENTION

The present invention is a lightable corner guard designed to fulfill the peculiar and special requirements of illuminating areas where even a momentary loss of orientation can result in occupant injury. My lighted corner guard has the efficacious of illuminating a corner edge by means of a diffused light source and includes a cover designed to protect persons and objects that impact the device. In accordance with this invention, the lighted corner guard is installed on a corner edge of two adjoining walls as part of the wall design or as an after market attachment. The device employs at least one lightable lamp that illuminates the outer surface of a support structure, the illumination of the structure can be viewed through the cover for even distribution of light throughout the device. An alternative embodiment of the device provides for illumination of the floor vicinity surrounding the device by an unfiltered light by means of light portals.

The light source of the lighted corner guard can be powered from a variety of power supplies. The lighted corner guard can be illuminated at all times in the similar manner as an exit sign although the preferred method of lighting is by use of dry cell batteries only during an emergency. Yet another embodiment allows the batteries to constantly charge by an AC power source and, in the event of a power loss, automatically switching to the DC battery supply for operation. Activation of the lighted corner guard can be triggered by a photosensitive cell, loss of primary power, smoke, sound, or other means indicating the need for light in the area. The lamps can made to remain on during an emergency situation, flash to save battery strength, or strobe to draw attention.

Due to the small amount of electrical power required to operate the device, the preferred embodiment houses all electrical components including the batteries within the confines of the base of the device. A switch is made available to test battery and lamp integrity. Alternatively, the electrical components can be placed in a junction box for simplicity in a multiple device system layout.

Accordingly, it is the primary object of the present invention to provide an aesthetically pleasing, simple, and reliable supplemental corner edge lighting system for commercial, residential, or similar applications.

Another object of the present invention is to provide an emergency lighting apparatus capable of illuminating a corner edge by means of a self-contained lightable corner guard that is attachable to the corner edge of two adjoining walls wherein a control circuit, lamp, and power supply are all contained within the confines of the apparatus.

Yet another object of the present invention is to activate the corner guard by the sound of a conventional smoke alarm.

Still another object of the present invention is to provide a corner guard for wall edges capable of absorbing impacts during emergency and non-emergency situations.

Yet still another object of the present invention is to provide an efficient and effective means of corner edge lighting by use of a light carrying film for distribution of a light source, the film having diffuse refraction characteristics.

Yet another object of the present invention is to provide a means for illuminating the floor area in the vicinity of the lighted corner guard.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
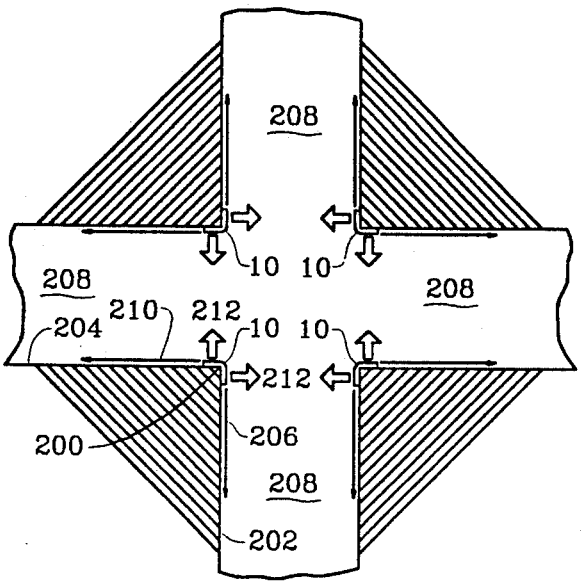
FIG. 1 is a top pictorial view of four illuminated lighted corner guards positioned on the protruding corner edge of adjoining walls at an intersecting corridor.

Referring to the drawings in more detail, FIG. 1 is a top pictorial view of two intersecting corridors whereby my lighted corner guard 10 attaches to a corner edge 200 typically formed in a 90 degree right angled pattern as illustrated by wall 202 and adjoining wall 204. Lighted corner guard 10 illumination includes a means for providing non-diffused directional lighting, as depicted along directional arrow 206 from the lighted corner guard 10 base illuminating the lower portion of wall 202 and a portion of the floor surface 208 near adjoining wall 202. In a similar fashion directional non-diffused light, as depicted along directional arrow 210 from the lighted corner guard 10 base illuminates the lower portion of adjoining wall 204 and a portion of the floor surface 208 near adjoining wall 204. Further, non-diffused light 212 is swept across the frontal floor area of lighted corner guard 10, which, in conjunction with the direction lighting from the side of lighted corner guard 10, provides non-diffused lighting encompassing the totality of floor surface area surrounding the lighted corner guard 10. Non-diffused light is directed through light portals which substantially block the direct level view of the light source. The light source is described in detail later in this embodiment as is the means for providing diffused lighting along the vertical length of the lighted corner guard.

Figure 2:
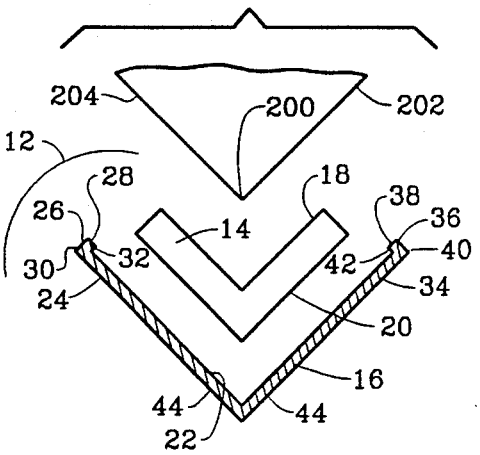
FIG. 2 is an exploded top view illustrating the support structure of the lighted corner guard.

Now referring to FIG. 2, an exploded end view illustrating a support structure 12 comprised of a spacer 14 and mounting member 16 each constructed of aluminum or the like rigid material. The spacer 14 is defined by an angular wall mounting surface 18 formed to cover the corner edge 200 and further extend over a portion of wall 202 and 204 for attachment thereto and a member mounting surface 20 for coupling to mounting member 16. The length of spacer 14 can be the same as mounting member 16 or formed of smaller separately spaced sections allowing sufficient surface area for securing the wall mounting surface 18 to walls 202 and 204 by suitable adhesive, screws, or other fasteners, and further providing sufficient surface area across mounting member surface 20 for support of mounting member 16. The purpose of spacer 14 is to provide a space between each wall surface and mounting member 16 for ease of installation and removal of additional lighted corner guard components that couple to the mounting member as later described.

Mounting member 16 is a right angled piece of extruded aluminum or the like rigid material with a length between one foot and fifteen feet, actual length dependent on consumers preference. A first side wing 24 is created by a portion of mounting member 16 that extends beyond member mounting surface 20 ending in a first winglet 26 perpendicular to mounting member 16 having an end surface 28, an outer surface 30 and an inner surface 32. In mirror image of the first side a second side wing 36 is formed by a portion of mounting member 16 that extends beyond member mounting surface 22 ending in a second winglet 36 perpendicular to mounting member 16 having an end surface 38, an outer surface 40 and an inner surface 42. An outer reflective surface 44 is polished to a specular finish or coated with a highly reflective surface coating such as paint, Alzak sheeting, or ScotchCal 220 diffuse reflective film.

Figure 3:
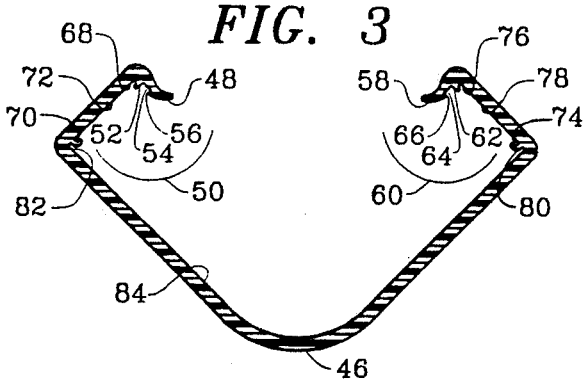
FIG. 3 is a top cross-sectional view illustrating the cover of the lighted corner guard.

Now referring to FIG. 3, cover 46 is a transparent, resilient single piece of curved elongated plastic with a means for attaching the cover 46 to the mounting member 16. The means for attaching a first side of cover 46 is created by tapered lip section 48 which prefaces groove 50 formed by inner surface 52, bottom surface 54, and lip surface 56. A mirror image locking means on a second side of cover 46 is created by tapered lip section 58 which prefaces groove 60 formed by inner surface 62, bottom surface 64, and lip surface 66. The first side and second side of cover 46 is of similar width perpendicular to their respective walls enhancing the surface area to be illuminated, actual cover side width dependent upon the type of light source employed and consumer preference. The cover 46 can be made of a optical grade clear, colored, or fluorescent plastic, permitting equal illumination of the cover 46 when illuminated from a single end. The preferred embodiment is to use a clear impact resistant plastic cover and include a means for adding the diffusion capability. Slots 68 and 70 allow placement of a diffuse optical grade polycarbonate film using prism angles for diffusion, such as 3M Scotch Lamp Film, on the inside side surface 72 of the cover 46 for maintaining said film against the inner side surface 72. Slots 74 and 76 allow placement of a diffuse film on an opposite side of cover 46 for maintaining said film against inner side surface 78. Slot 80 is placed one side of cover 46 and slot 82 at the opposite for insertion of a diffusion film spanning the inner surface 84 of the cover 46. It should be noted the width of the slots accommodates the width of the diffusion film.

Figure 4:
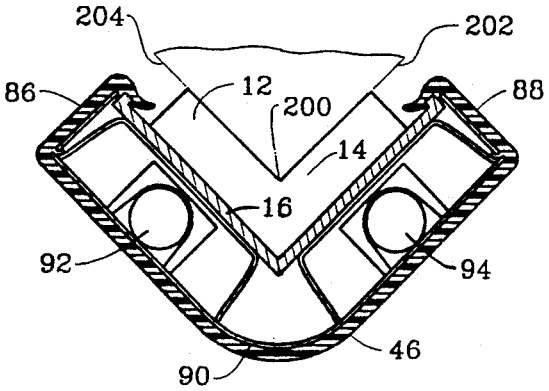
FIG. 4 is a top cross-sectional view illustrating the support structure, cover, diffuse film, light source, and their interfitting mode of engagement.

Now referring to FIG. 4, a top cross-sectional end view combining the components of FIG. 2 and FIG. 3 illustrating their interfitting mode of engagement. The support structure 12 covers the corner edge 200 and secures to adjoining walls 202 and 204. Coupling the cover 46 to mounting member 16 of the support structure 12 is performed by placing tapered surface 48 against winglet 26 and applying sufficient force to slide tapered surface 48 across end surface 28 until winglet 26 is situated within groove 50 whereby end surface 28 is flush with bottom surface 54, outer surface 30 is flush with inner surface 52, and inner surface 32 is flush with lip 56. Groove 50 is of sufficient depth to lock the cover 46 to winglet 26 preventing accidental disassembly and creating a seal for prevention of contaminates from entering the housing. In a similar fashion tapered surface 58 is placed against winglet 36 and sufficient force applied to slide tapered surface 58 across end surface 38 until winglet 26 is situated within groove 60 whereby end surface 38 is flush with bottom surface 64, outer surface 40 is flush with inner surface 62, and inner surface 42 is flush with lip 66. Groove 60 depth of 0.020 inches is sufficient to lock the cover 46 to the winglet 36 preventing accidental disassembly and creating a seal to prevent contaminates from entering the housing.

Removal of the cover 46 from the mounting member 16 is performed by lifting tapered surface 48 separating bottom surface 54 from end surface 28 allowing the inner surface 32 to be free of lip 56 allowing winglet 26 removal from groove 50. Similarly tapered surface 58 is lifted to separate bottom surface 64 from end surface 38 allowing inner surface 42 to be free of lip 66 allowing winglet 36 removal from groove 60. It is to be noted that installation or disassemble can begin with either side.

FIG. 4 and FIG. 3 further illustrates placement of a first side diffuse film section 86 in slots 68 and 70, a second side diffuse film section 88 in slots 74 and 76, and a frontal side diffuse film section 90 in slots 80 and 82. Dual lamps 92 and 94 are shown at the bottom of the device illustrating the unobstructed space between inner reflective surface 20 and diffusion film section 86, 88, 90. Cover 46 is thus illuminated by direct and reflected illumination along the length of diffuse film section 86, 88, 90 and also by reflected illumination from outer reflective surface 20 along its entire surface, supplementing the reduced intensity of direct illumination and providing a widely diffused and substantially uniform illumination of the entire cover 46 of the lighted corner guard 10. Use of diffuse optical grade polycarbonate film with prism angles allows for uniform diffusion along the length of said film with minimal loss of intensity throughout the length of said film.

Figure 5:
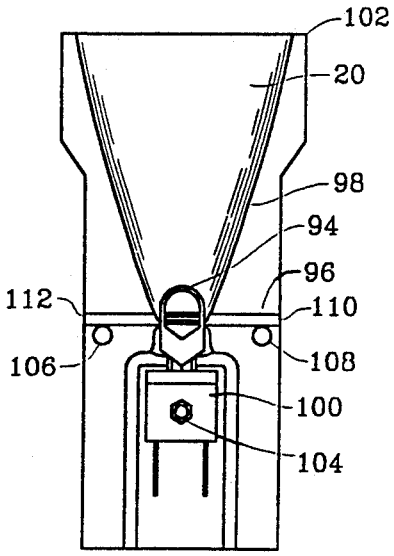
FIG. 5 is a perspective view of the lower portion of the lighted corner guard housing the light source.

Now referring to FIG. 5 lamp 94 is shown in a lamp base 96 constructed of extruded aluminum or flame retardant thermoplastic material whereby optimum light focusing is obtained by a focusing aperture formed by narrow opening 98 near lamp 94 and electrical connection socket 100 to an aperture width approximately the size of one half the inner reflective surface 20 at the top 102 of lamp base 96. The light from lamps 92,94 are of Xeon flash tubes with a filament orientation parallel with their respective inner reflective surface 20. The use of mounting screw 104 secures electrical connection socket 100 in the correct orientation to lamp base 96. Lamp base 96 is further secured to mounting member 16 by mounting screws 106, 108. Side light portal 110 and 112 provide a passage for unfiltered directional lighting from either side of lamp base 96 with portal placement allowing illumination of a lower portion of an adjoining wall and a portion of the floor surface near the adjoining wall. For optimum lamp efficiency, a single portal is formed in each lamp base 96 depending upon placement of the lamp base in conjunction with the lighted corner guard. For example, if lamp base 96 is to be used to illuminate a right side wall then lamp base 96 will have a single lamp portal 110 providing directional light only to the right side of the lamp base 96, while a lamp base 96 used to illuminate a left side wall will have a single lamp portal 112 providing directional lighting only to the left of lamp base 96. If a loss of electricity occurs, the electrical components automatically switches to a DC battery supply for continuous operation. Activation of the device is triggered by a photosensitive cell, loss of primary power, or other means indicating the need for light in the area. The preferred embodiment sets forth a lightable corner guard that is self-contained in that the apparatus can be easily attached to any protruding edge by adhesive or nails with the power source obtained from five 1.5 volt batteries. The corner guard is placed in a stand-by mode wherein operation occurs upon receipt of an emergency condition, namely, the alarm sound from a conventional smoke alarm wherein a control circuit utilizes a microphone to detect the smoke alarm and energize the lamps.

Figure 6:
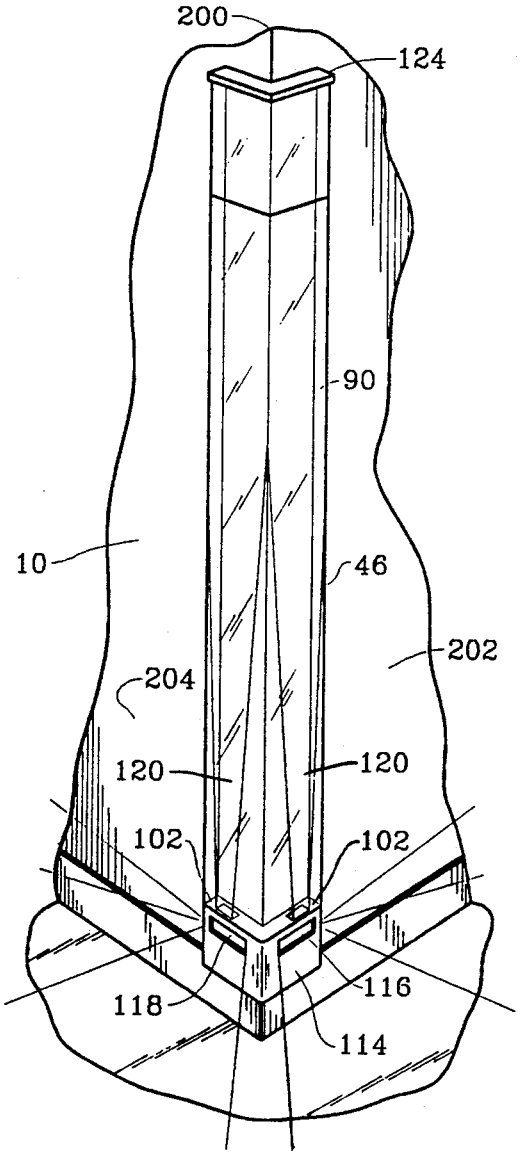
FIG. 6 is a cross sectional side view of an embodiment of the lighted corner guard shown attached to a corner edge.

FIG. 6 is a perspective view of an illuminated lighted corner guard 10 as installed upon wall 202 and adjoining wall 204 covering a portion of protruding edge 200. The view illustrates a lamp base shroud 114 made of metal or heat resistant thermoplastic with an inner reflective surface which is releasably coupled to lamp base 96 for protection of lamps 92, 94 and ease of replacement thereof. Further, unfiltered light is swept across the frontal floor area in front of the device by light portal 116 in front of lamp 94 and light portal 118 in front of lamp 92. Cover 46 is illustrated with frontal side diffuse film section 90 shown throughout the length of the cover. While use of a single frontal section of diffuse film is acceptable I have found that inverted triangular pieces of diffuse prismatic film 120 further enhances light transmission when placed directly over the top of the lamp base 102 between the frontal diffuse film 90 and the inner surface 84 of cover 46. A cap 124 of metal or plastic is releasably coupled to the top end of lighted corner guard 10 with a reflective surface facing the lamp source to optimize available lighting and of a close fit to prevent contaminants from entering the lighted corner guard 10.

Figure 7:
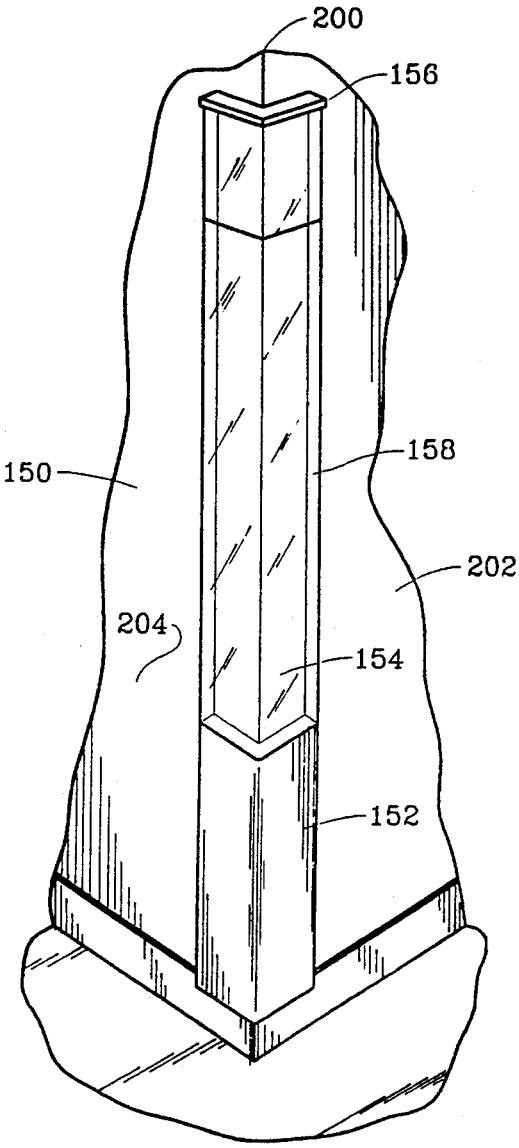
FIG. 7 is a perspective view of the preferred embodiment of the lighted corner guard shown attached to a corner edge.
Figure 8:
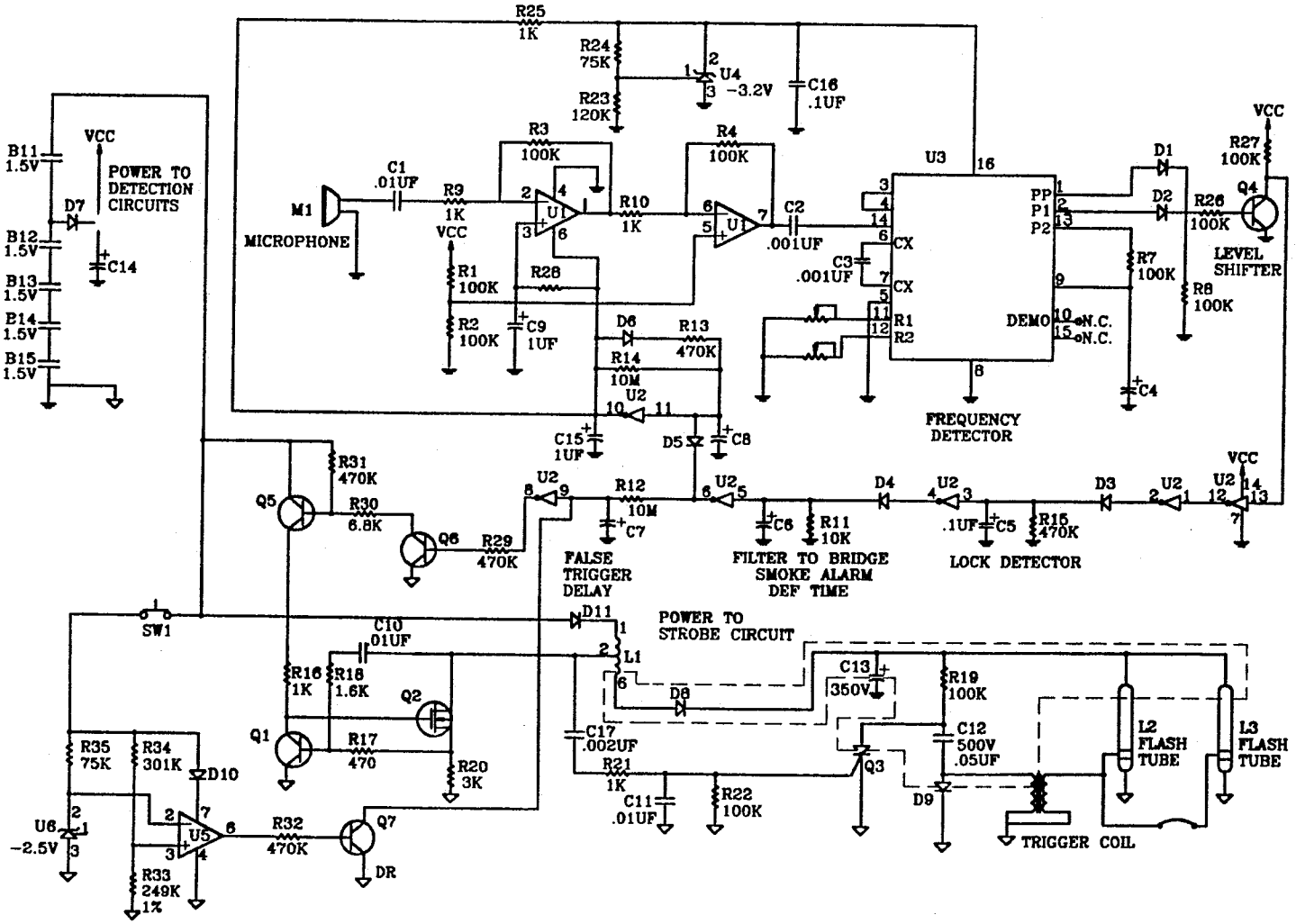
FIG. 8 is an electrical schematic of a preferred embodiment.

Referring to FIG. 7, shown is the preferred embodiment of the instant invention lamp 150 shown as a self contained corner guard having an enlarged base 152 for housing of the electronics set forth in FIG. 8. The housing is made of flame retardant thermoplastic material with the transparent cover guard 154 coupled thereto with cap 156. Illumination of the lamps through the cover ensures visibility to a distance of hundreds of feet in a situation of 50% smoke cover. In the event of an emergency, the device of the preferred embodiment works in conjunction with a smoke detector providing lamp flashing at 3 second intervals pointing the way to the nearest exit. The unit is powered by "AA" batteries and meets ASTM standard D-1929. The lighted corner guard 150 is installed upon wall 202 and adjoining wall 204 covering a portion of protruding edge 200 in the same manner as the aforementioned embodiment.

Now referring to FIG. 8, the preferred embodiment of the instant invention is set forth having flash tubes L2 and L3 such as Xeon flash tubes Amglo AKL3512, or the like, energized by a power source. Operation of the control circuit can be described by referring to the major stages of the control circuit label on the schematic. In operation, the sound from a conventional smoke detector is received by a microphone and the frequency of which is sent through two a stage amplifier before delivery to a phase lock loop which detects the frequency of sound, the frequency span is made adjustable to the sound of a conventional smoke alarm by potentiometers. The output of the phase lock loop is rectified by diodes and sent through a transistor level shifter to place the logic at levels acceptable to the remaining circuit. The output is delivered through a chain of gates to provide a steady signal by locking onto the frequency using a capacitor filter to remove extraneous noise. The signal is maintained for approximately ten seconds after the smoke alarm is started to prevent false triggering, however, as long as the smoke alarm is in its alarm mode, the lighted corner guard will operate continuously.

If the smoke alarm stays in the operational mode, a signal is delivered to a flasher circuit through a transistor circuit which operates an oscillator. The output of the oscillator is delivered to two components: first to a monostable circuit which will trigger the flasher circuit and second to a strobe circuit comprised of a transformer which increases the voltage to approximately 250 volts. The oscillator triggers the flasher circuit to strobe the lamps at approximately 25 flashes per second. Switch SW1 is provided to test the control circuit and batteries by setting forth a comparator circuit which requires minimal battery power to allow the flash tubes to flash at the minimum design rate of 20 flashes per second. If the smoke alarm turns off, the control circuit will turn off after ten seconds and return to a sleep mode to conserve battery power. The following is a detailed description of the schematic components. The power source provides power to the detection circuits though VCC with diode D7 to check reverse flow and 2.2 uF capacitor C14 sink to ground. The power source further supplies power to the strobe circuit prefixed by diode D11 providing power to high voltage flashback inductor L1 checked by diode D8 with a 20 MFD dipped tantalum capacitor C13 to flash tubes L2 and L3, sink provided by trigger coil T1 with diode D9 operatively associated with a 0.05 MFD disk capacitor C12 coupled to 100K resistor R19 fed by a first 0.002 uF capacitor C17 through 1K resistor R21 using 0.01 MFD capacitor C11 and 100K resistor R22 to ground joining SCR Q3 to the interim of R19 and C12. The unit flashes on and off at 3 second intervals after initiation by an external smoke alarm. MOSFET logic level switching is provided by Q2 with 3 ohm resistor R20 to ground. R17 is a 470 ohm resistor coupled to transistor Q1 coupled to the high voltage flyback L1 by 1.6K resistor R18 and 0.01 MFD capacitor C10.

For flash enable, the flash circuit delivers through 1K resistor R16 and/or transistor Q5 having a 470K bypass resistor R31 feeding 6.8K resistor R30 to Q6 transistor and 470K resistor R29 to inverter U2D with 2.2 UF capacitor for false trigger delay. 10M resistor R12 to diode D5 and inverter U2E with C15 capacitor 1UF proving a sleep oscillator which feeds a microprocessor by use of a stabilized power supply provided by 1K resistor R25 coupled to the positive side of precision volt reference U4 and FB reference by resistor R24 rated at 100K with sink resistor R23 rated at 150K. The precision volt reference providing the stable power supply for VCO frequency, supply presented to pin 16 of CMOS phase lock loop IC U3 with 1UF capacitor C16 for variations. IC U3 is preferably a Motorola MC14584BCP, pin 1 coupled to diode D1, pin 2 coupled to diode D2 with outputs coupled to together with sink to 100K resistor R8 to 100K resistor R26 to level shifter transistor Q4 having VCC input through 100K resistor R27 to series placed inverters U2F having a VCC connection and U2A further coupled to diode D3 having lock detection by 470K resistor R15 and 0.1 UF capacitor C5 with inverter U2B and a filter to bridge smoke alarm off time provided by diode D4 with inverter U2C with 470K resistor R11 and 1UF capacitor C6. Pin 13 of U3 coupled to pin 9 by 100K resistor R7 with pin 9 directly coupled to 1UF capacitor C4. Pin 3 and pin 4 electrically coupled, pin 6 and pin 7 coupled through 0.001 capacitor C3. Pin 5 to ground, pin 11 employing a 2M potentiometer R5 as well as pin 12 through 2M potentiometer R6 wherein the potentiometers are used to adjust VCO range and detection window. Signal in of pin 14 electrically coupled to 0.001 UF capacitor C2 to dual op amp U1B with bypass provided by 100K resistor R4 to 1K resistor R10 to op amp U1A having 100K resistor bypass R3 to 1K resistor R9 to 0.01 UF capacitor C1 to microphone M1, microphone further brought to sink. The microphone causing operation upon the sound of a conventional smoke alarm. When the unit is operated the lamps will flash at the rate of 20 timers per minute after the smoke alarm has sounded for 6 seconds. The device is sensitive only to the alarm and cannot be false triggered by normal background noise. Op amp U1B coupled to op amp U1A positive, VCC provided through resistor R1 to sink by 100k resistor R2 and 1UF capacitor C9. Op amp U1A having series coupling diode D6 and 470K resistor R13 to 10M resistor R14 across inventer U2E with capacitor C15 and 10 UF-10 V dipped tantalum capacitor to C8 to sink.

The circuit can be switched SW1 wherein the supply power is delivered to the circuit through 75K resistor R35 to pin 2 of inverter U5 having zene diode U6 sinking about 2.5 volts. Resistor R34 having a 1% percent resistance before pin 3 of inverter U5 which is fed by diode D10, the output fed through 470K resistor R32 to transistor Q7 provides a test for the control circuit and batteries by setting forth a comparator circuit which requires the flash tubes to flash at the minimum design rate of 20 flashes per second checking both the control circuit and the battery strength.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A lightable corner guard comprising:

an elongated substantially right angled rigid support structure having a length and a width, said width demarcated by two side edges defining an inner surface and an outer surface, said inner surface adapted to be secured to at least a portion of a protruding corner edge of two adjoining walls;

an elongated transparent flexible plastic cover releasable engageable to said two side edges of said support structure defining a deformable chamber between said outer surface of said support structure and an inner surface of said cover; and a means for illumination of said outer surface of said support structure, said means for illumination comprised of at least one lamp, a lamp lighting control circuit, and an electrical source to energize said lamp in response to said control circuit whereby activation of said control circuit directs said electrical source to energize said lamp providing illumination of said outer surface of said support structure that is viewable through said cover.

2. The corner guard according to claim 1 wherein said outer surface of said support structure is coated with a reflective material.

3. The corner guard according to claim 1 wherein said chamber is available for the insertion of a sheet of reflective material.

4. The corner guard according to claim 1 wherein said flexible plastic cover is further defined as polycarbonate conforming to said support structure, said cover including a means for securing to said two side edges of said support structure.

5. The corner guard according to claim 4 wherein said cover has diffuse refraction characteristics.

6. The corner guard according to claim 1 wherein said means for illumination includes a means for directing lamp light.

7. The corner guard according to claim 1 wherein said support structure includes a light portal for directing unfiltered lamp light.

8. The corner guard according to claim 1 having a means for securing a prismatic film on the inner surface of said chamber.

9. The corner guard according to claim 1 wherein said control circuit coupled to said means for illumination is an IC based circuit activated upon the presence of smoke.

10. The corner guard according to claim 1 wherein said control circuit coupled to said means for illumination is an IC based circuit activated upon lost of external power by a means for switching from an alternating current source to a direct current source.

11. The corner guard according to claim 1 wherein said control circuit coupled to said means for illumination is an IC based circuit activated by a means for detecting sound from a conventional smoke detector, said means for detecting including a means for frequency amplification and frequency stabilization.

12. The corner guard according to claim 1 wherein said electrical source is defined as a plurality of dry cell batteries secured to said support structure.

13. The corner guard according to claim 1 wherein said control circuit includes a means for strobing said lamp, said means for strobing having a step-up transformer electrically coupled to an oscillator for strobing said lamp at a rate of 25 flashes per second.

14. The corner guard according to claim 1 wherein said control circuit electrically coupled to said illumination means comprises an IC based circuit having one of a continuous mode and a strobe flashing mode.

15. A lightable corner guard comprising: a support structure having a length and a width, said width demarcated by two side edges defining an inner surface and outer surface, said inner surface adapted to be secured to at least a portion of said corner edge formed by said two adjoining walls, said outer surface having a coating of reflective material; a light source having at least one flash tube coupled to said support structure; a lamp lighting control circuit electrically coupled to said light source, said control circuit activating said light source upon microphonic receipt of sound from a conventional smoke alarm employing a means for amplification and stabilization of said sound and a means to delay activating and deactivating said light source; an plurality of dry cell batteries electrically coupled to said lamp lighting control circuit; a translucent plastic cover means for releasably coupling said cover to said support structure; and a means for distributing light from said light source between said support structure and said cover for reflection, refraction and diffusion through said cover.

* * * * *